US005365825A

United States Patent [19]

Marin

[11] Patent Number: 5,365,825

[45] Date of Patent: Nov. 22, 1994

[54] SHEET TURNING DEVICE

[76] Inventor: Manuel Marin, 10134 Avenue des Laurentides, Apt. 4, Montréal Nord, Québec, Canada, H1H 4V3

[21] Appl. No.: 230,229

[22] Filed: Apr. 20, 1994

[51] Int. Cl.[5] ..... G10G 7/00

[52] U.S. Cl. ..... 84/489; 84/497

[58] Field of Search ..... 84/487, 489, 486, 490, 84/495, 497

[56] References Cited

U.S. PATENT DOCUMENTS

| | | | |
|---|---|---|---|
| 2,545,839 | 3/1951 | Blez | 84/521 |
| 4,463,651 | 8/1984 | Hammer | 84/504 |
| 4,882,969 | 11/1989 | Ricca | 84/487 |
| 5,052,266 | 10/1991 | Burster | 84/493 |

FOREIGN PATENT DOCUMENTS

| | | | |
|---|---|---|---|
| 746221 | 11/1966 | Canada | 40/35 |
| 1080074 | 6/1980 | Canada | 129/2 |

*Primary Examiner*—Michael L. Gellner
*Assistant Examiner*—Patrick J. Stanzione
*Attorney, Agent, or Firm*—Pierre Lespérance; Francois Martineau

[57] ABSTRACT

A sheet turning device for printed sheets supported on a stand which includes a transparent jacket for each sheet, a sheet turning rod secured to each jacket of the stack, the several rods extending side by side, a lever arm fixed to each rod, whereby pulling on a selected lever arm causes rotation of the associated rod and turning of the sheet to the jacket of which the rod is fixed. A set of selector members are disposed side by side and are longitudinally movable in a guide, each selector member is attached to one lever arm. A common pulling member is movable back and forth in a predetermined path under the action of an electromagnet controlled by a foot-actuated switch. The first pulling action causes the first sheet to be turned since only the selector member associated with the first sheet is pulled. During operative movement of the first selector member it raises the next selector member which is then in a position to be engaged and pulled by the pulling member upon the next pulling movement so as to turn the second sheet. The action is repeated for all the sheets of the stack.

15 Claims, 4 Drawing Sheets

SHEET TURNING DEVICE

FIELD OF THE INVENTION

The present invention relates to a sheet or page turning device which is remotely operated for instance foot-operated.

BACKGROUND OF THE INVENTION

Various types of power operated page turning devices are available, most are foot-operated such that, for instance, a musician reading music on a stand does not have to use his hand to turn a page. U.S. Pat. No. 4,882,969 dated Nov. 28, 1989 inventor Tom L. Ricca and entitled PAGE TURNING DEVICE describes a mechanism which takes room and is composed of numerous expensive parts which require precision manufacturing. Another page turning device is described in U.S. Pat. No. 2,545,839 dated Mar. 20, 1951 inventor B. Blez and entitled PAGE TURNING DEVICE. In this patent a swing arm carries at it's outer end an electromagnet which attracts a tab of magnetic metal which has to be glued to each page to be turned.

OBJECTS OF THE INVENTION

It is a general object of the invention to provide a sheet turning device of the character described which is an improvement over the prior art in that it is of simple, rugged and rather inexpensive construction.

Another object of the present invention is to provide a sheet turning device of the character described using as a power source a single power operated reciprocating plunger successively engageable with selector members individually rotatably connected to each sheet to be turned.

Another object of the present invention is to provide a device of the character described incorporated in a sheet stand such as a music stand.

SUMMARY OF THE INVENTION

The sheet turning device of the invention comprises a support for holding a stack of sheets to be successively turned, a sheet turning rod rotatably secured to each sheet, the several rods extending side by side, journal means to rotatably support the rods for independent rotation about their longitudinal axis, a lever arm fixed to each rod whereby pulling a selected lever arm causes rotation of the associated rod and sheet, a set of selector members disposed side by side and each longitudinally movable and attached to one of said lever arms, guide means to guide the selector members in their longitudinal movement, a common pulling member movable back and forth in the direction of said longitudinal movement, said pulling member successively engageable with said selector members to move the same from an initial position to a final position to turn a sheet, each selector member having a pulling member engaging part and a selector member engaging part. The pulling member engaging part of all the selector members except one clearing the path of said pulling member while in their initial position, the selector engaging part of all the selector members slidably engageable with only the next selector member of the set, and adapted to transversely shift the next selector member to a shifted position in which its pulling member engaging part is in the path of said pulling member ready to be pulled by the latter from its initial to its final position during the next pulling stroke of the pulling member.

Preferably each selector member is in the form of a piano wire bent to form an upstanding hook at one end and an intermediate laterally extending extension, the hook defining the pulling member engaging part and the extension the selector member engaging part.

Preferably the guide means is formed by a plurality of spaced parallel, flat plates defining guiding channels for the wires, the plates having a longitudinal slot through which the lateral extension of the next preceding selector wire extends to engage a downwardly inclined portion of the successive selector wire so as to cause upward shifting of the latter when the next preceding selector wire moves from its initial to its final position. Preferably the common pulling member includes a pivoted hook which upon its return movement to its initial position rides over the raised hook of the next selector wire and drops back behind the latter under the action of a tension spring.

The journal means are arranged for easy installation and removal of the sheet turning rods. Preferably, the music sheets or the like are inserted into transparent jackets fixed to the sheet turning rods.

BRIEF DESCRIPTION OF THE DRAWINGS

In the annexed drawings.

In the annexed drawings like reference characters indicate like elements throughout.

DETAILED DESCRIPTION OF THE PREFERRED EMBODIMENTS

Figure 1:
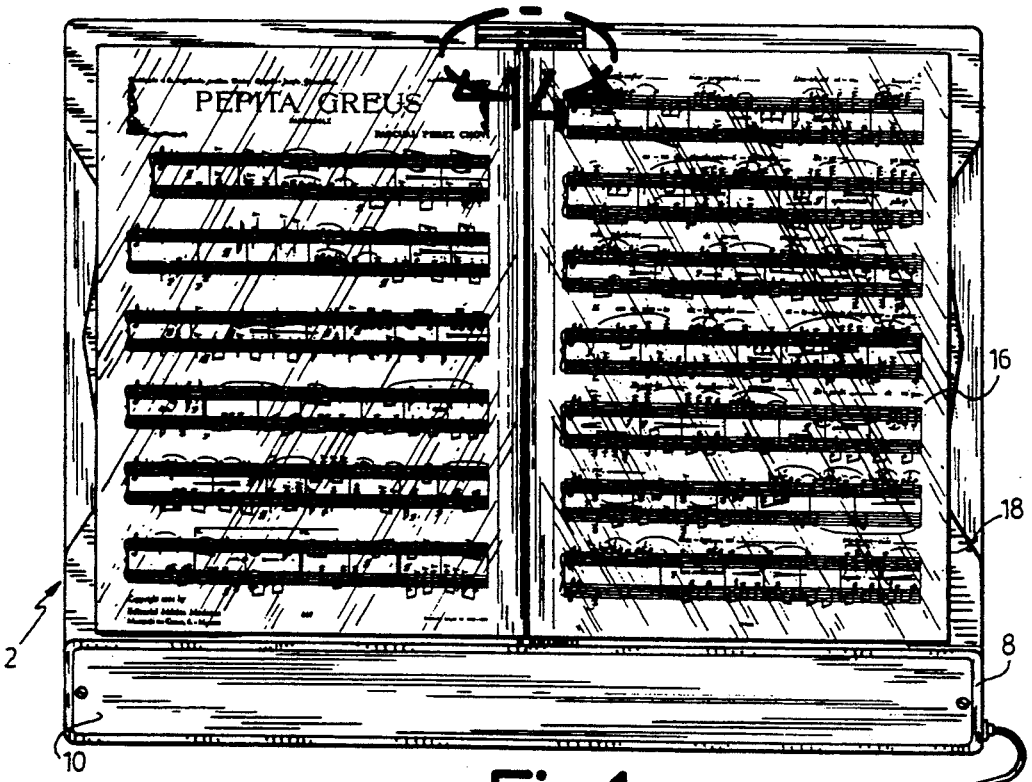
FIG. 1 is a front elevation of a music stand incorporating the sheet turning device in accordance with the invention.
Figure 2:
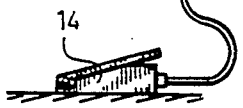
FIG. 2 is a side elevation of the music stand of FIG. 1.
Figure 2:
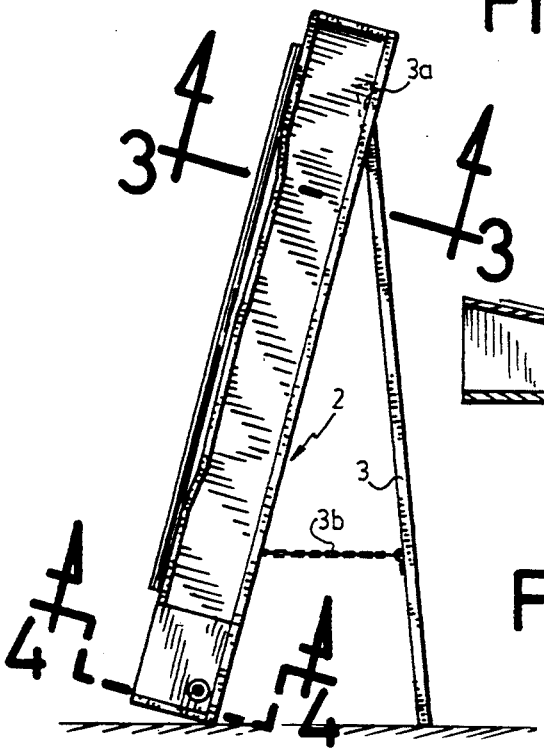
Figure 3:
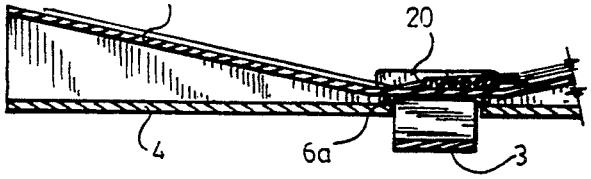
FIG. 3 is a partial section taken along line 3—3 of FIG. 2.
Figure 4:
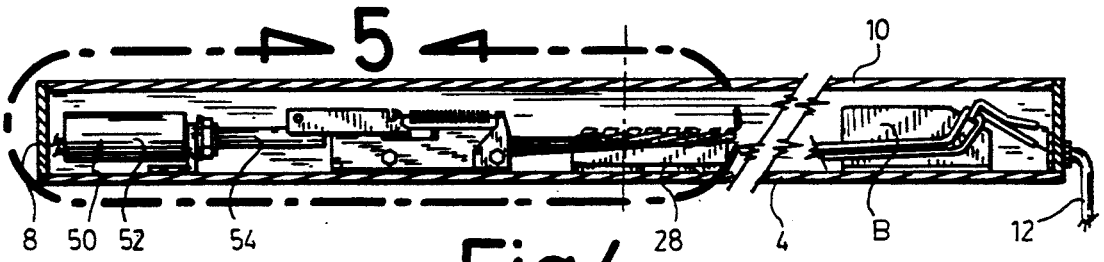
FIG. 4 is a bottom section taken along line 4—4 of FIG. 2.
Figure 5:
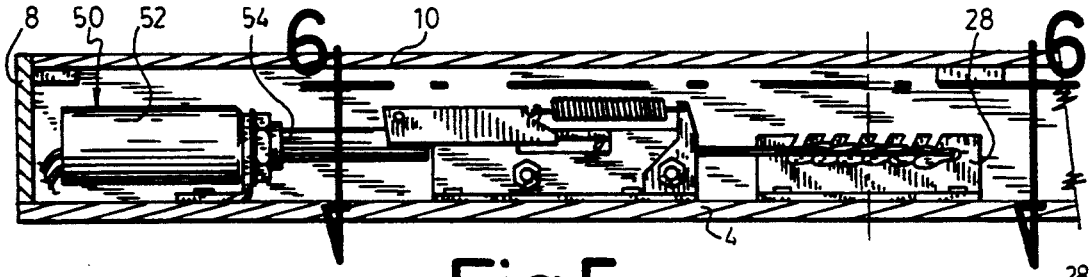
FIG. 5 is partial section on an enlarged scale taken in area 5 of FIG. 4.

FIGS. 1, 2 and 3 shows a music stand 2 supported in inclined position by a bracing leg 3 pivoted at *3a* to the top portion of music stand 2 and retained to an operative limit position by a retaining chain *3b*. Music stand 2 includes a backing wall 4 and a front wall 6 composed of two mutually diverging front wall sections united by a central section *6a* which is parallel to and disposed flat against the back wall 4. An elongated compartment 8 which houses a main part of the sheet turning device of the invention is formed at the lower part of music stand 2. Compartment 8 is closed by a removable cover 10.

From one end of the compartment 8 issues an electric cord 12 electrically connected to a foot operated pedal switch 14.

Figure 14:
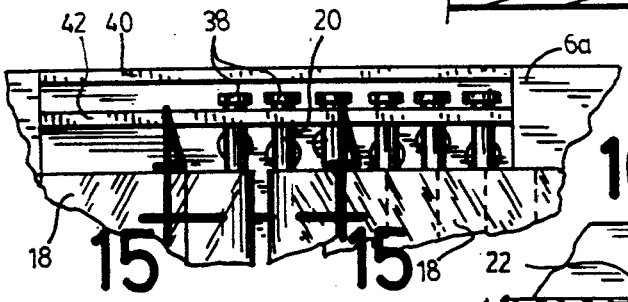
FIG. 14 is a partial top plan view taken in area of FIG. 1.
Figure 15:
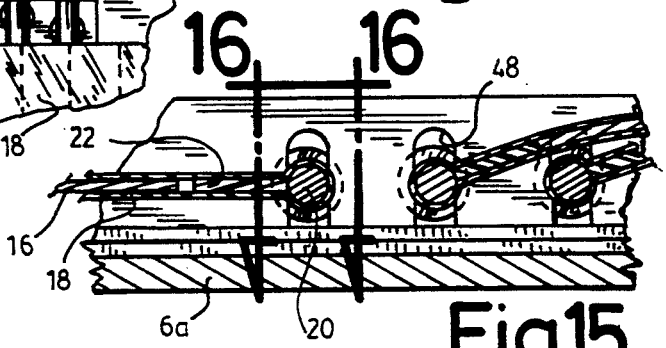
FIG. 15 is a partial cross-section taken along line 15—15 of FIG. 14.
Figure 15A:
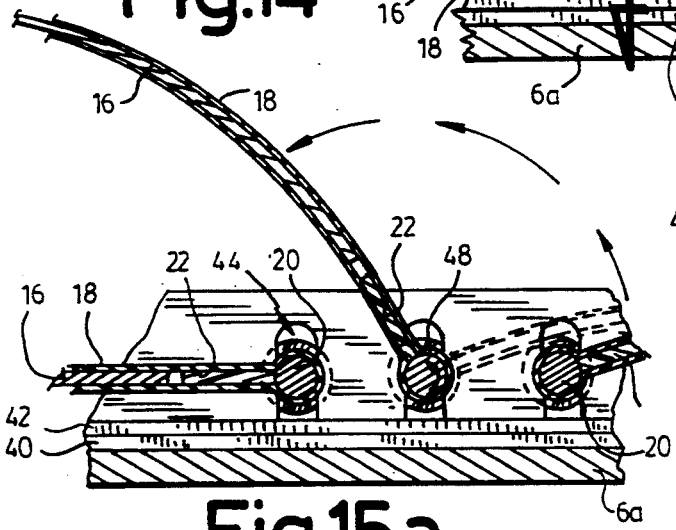
FIG. 15*a* is a view similar to that of FIG. 15 and showing turning of a sheet.

A plurality of individual printed sheets such as music sheets 16 are each removably enclosed in a transparent jacket 18 (see also FIGS. 14, 15 and *15a*). A sheet turning rod 20 is inserted through the inner edge portion of each of the transparent jackets 18 and is glued or otherwise secured to the associated jacket 18 together with a spacer strip 22 which maintains the two sides of the jacket 18 apart to facilitate insertion of a sheet 16 through the upper open end of the jacket. The music sheet 16 together with their individual jackets 18 are disposed in a stack on the right side of the music stand to be successively turned by the associated sheet turning rod 20 onto the left side of the music stand so that each opposite page of the sheet 16 can be read.

Figure 6:
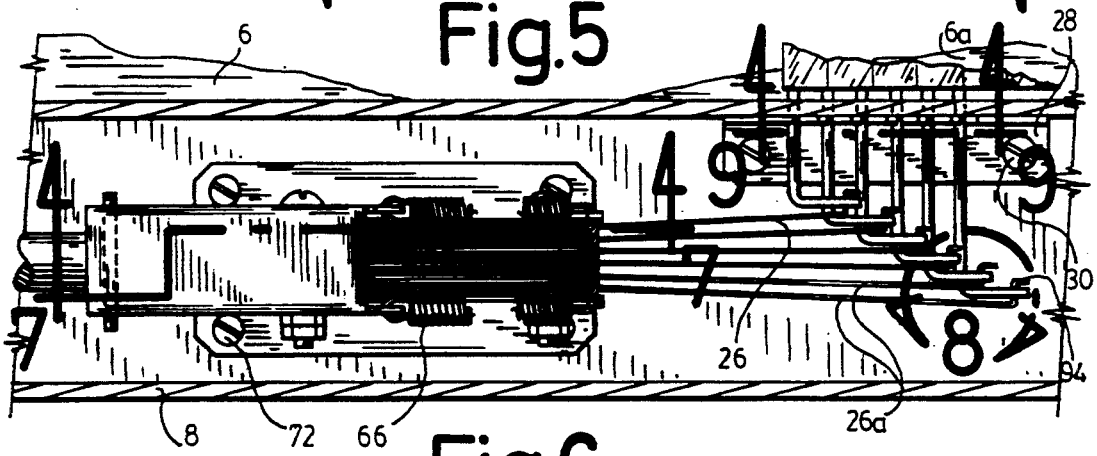
FIG. 6 is top plan view taken along line 6—6 of FIG. 5.
Figure 8:
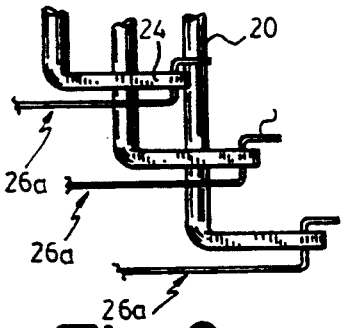
FIG. 8 is a partial plan view taken in area 8 of FIG. 6 and showing the connection of the sheet turning rods to the selector wires.
Figure 13:
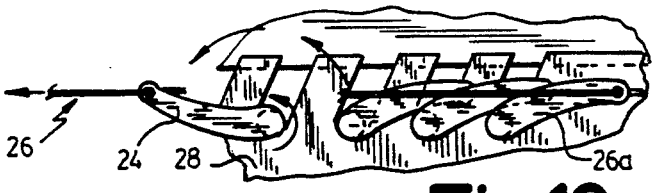
FIG. 13 is a view similar to that of FIG. 9 but showing the lever arms at the end of the sheet turning rods.

The rods 20 are disposed side by side in a parallel relationship across central section *6a* of front wall 6. Each rod 20 is journaled at its top and bottom end for rotation through approximately half a turn for turning of the associated jacket 18 and enclosed sheet 16. Each sheet turning rod 20 has a laterally extending lever arm 24 at its bottom end as shown in FIGS. 6, 8 and 13. Lever arms 24 successively serve to rotate the rod 20 by means of a first selector 26 and second selectors *26a* pivotally attached thereto as will be described hereinafter.

Figure 9:
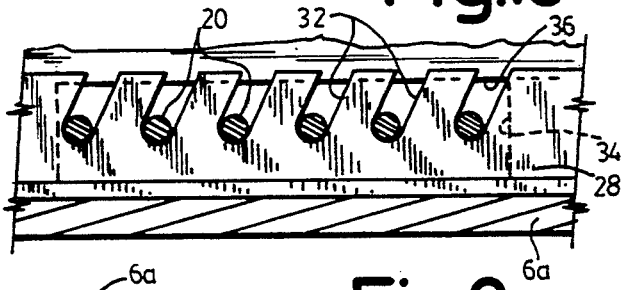
FIG. 9 is a partial cross-section taken along line 9—9 of FIG. 6.

Adjacent lever arm 24, the rods 20 are journaled in side by side relationship in a journal bracket 28 which is an angle iron removably fixed to the central section *6a* of front wall 6 by means of screws 30 as shown in FIG. 6. The outstanding flange of journal bracket 28 has a series of parallel notches 32 which are equally inclined towards the selectors 26, *26a*; when the selectors 26, *26a* pull on the lever arms 24 to rotate the rods 20, the latter tend to engage the bottom of the notches 32, As shown in FIGS. 6 and 9, the rods 20 freely extend through an opening 34 made in the corresponding wall of the compartment 8. The rods are locked in their respective notches 32 by the edge 36 of opening 34 which extends below the top edge of the bracket 28; whenever removal of the rods 20 from journal bracket 28 is desired, screws 30 must be removed.

Figure 16:
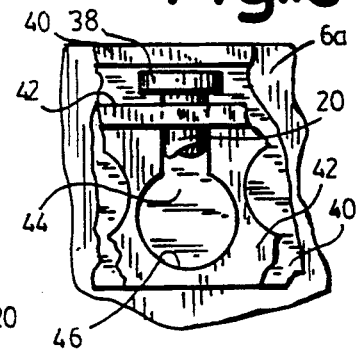
FIG. 16 is a partial top view taken along line 16—16 of FIG. 15.

The top end of each rod 20 is formed by an enlarged head 38 (see FIGS. 14 to 16 inclusively) which is prevented from axial movement by extending between the upright flanges of two superposed angle irons 40 and 42 the bottom flanges of which are directly secured to the music stand 2 in a removable manner by means of end screws such as screws 30. The upper angle iron 42 has a series of bayonet slots 44 which are equally spaced and each one for receiving one page turning rod 20. The enlarged portion 46 of each bayonet slot together with a portion of the restricted slot part 48 extends through the horizontal flange while the remaining portion of the restricted slot part 48 extends through the vertical flange of the angle iron 42 as shown in FIG. 15. The lower angle iron 40 has no slots or perforations.

In the locked position of rods 20, their heads 38 are retained between the two vertical flanges of the angle irons 40, 42 and can rotate against the horizontal flange of the lower angle iron 40. To disengage the rods 20 from their upper journals at least the top angle iron 42 must be removed then slightly rotated with respect to the rods 20 so that the heads 38 will be able to move under the horizontal flange of angle iron 42 and then up through the enlarged slot portion 46. The reverse operation is effected to lock the upper portions of the rods within the respective upper journals.

Referring to FIGS. 4 to 8 and 10 to 12, there is shown the power operated mechanism which is located within compartment 8 and which is used to successively and sequentially rotate rods 20 and consequently the printed sheets 16 associated therewith, one rod being turned each time the foot operated pedal switch 14 is actuated.

This mechanism includes a common pulling assembly indicated at 50 which includes an electromagnet in a housing 52 and acting on a plunger 54. The electromagnet is electrically connected to a battery B (see FIG. 4) which is serially connected with pedal switch 44.

To the outer end of plunger 54 is fixed by a bolt and nut 56, a bracket 58 onto which is pivotally connected a hook 60 by a pivot pin 62. Hook 60 is of U-shaped cross-section, its lateral walls forming a retaining finger 64 to which is attached one end of a tension string 66 the other end of which is attached to a bracket 68 which is part of a guide block generally indicated at 70 which is in turn fixed by screws 72 (see FIG. 6) to the bottom of the compartment 8. There are two springs 66, one on each side of the hook 60 to better equalize the tension force exerted on the hook 60.

When the electromagnet is energized, the plunger 54 effects an active pulling stroke in the direction of arrow 74 (see FIG. *7a*) and this pulling movement is effected against the bias of the tension strings 66. When the electromagnet is de-energized, tension strings 66 return the hook 60 and the plunger 54 to its initial rest position in the direction of arrow 76 (see FIG. *7b*). The operative stroke of hook 60 is effected by pressing down on the pedal switch 14; upon release of the latter the hook 60 effects a return stroke under the action of the tension strings 66.

Guide block 70 is composed of a series of rectangular sheet metal plates 78 arranged in spaced parallel relationship and secured to each other by cross bolts 80 with intermediate spacer washers 82. Tension spring retaining bracket 68 is also secured to the assembly of the plates 78 by one of the bolts and nuts 80 at the front end of the block which is closer to the sheet turning rods 20. Each pair of plates 78 define a guiding channel for one selector 26 or *26a*; these guiding channels are all parallel to each other and normal to the rods 20. There is defined a first guide channel 84 housing and guiding a first selector 26 which is pivotally attached to the nearest page turning rod 20 of the series of such turning rods, this nearest turning rod corresponding to the topmost printed sheet 16 of the stack of such sheets initially resting on the right hand side of the stand 2. The next succeeding guiding channels 86 each houses and guides for reciprocating longitudinal movement the remaining selectors 26a.

The first guide channel 84 is in communication with the next guide channel 86 and the latter are all in respective communication through an elongated opening 88 made in plates 78. Each plate 78 is formed with a transverse end flange 90 at its end nearer the rods 20 and each end flange 90 is formed with a notch 92 through which is guided against excessive vertical movement the end of the selector 26 or 26a.

Each selector 26 or 26a is made of a piano wire. Each selector wire is bent laterally then axially to form an L-shaped portion 94 which is inserted through a hole in the outer end of the associated lever arm 24 (see FIG. 8 and 13) to pivotally connect each selector 26 or 26a to a respective sheet turning rod 20.

Figure 7:
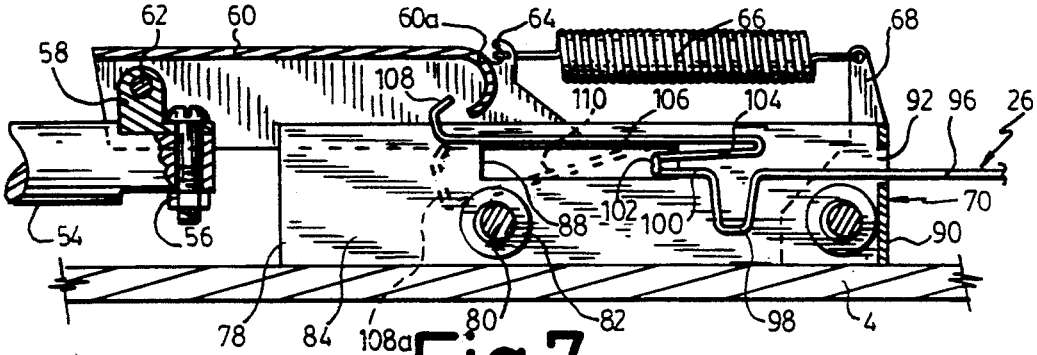
FIG. 7 is a partial section taken along line 7—7 of FIG. 6.

The first selector 26, which is uppermost and closer to the upper end of the music stand 2, has a shape which is different from the remaining selectors 26a. The first selector 26 is shown in FIG. 7; its inner L-shaped end portion 94 is followed in the outward direction by a straight portion 96 which extends through the notch 92 and which is followed by a downwardly extending U-shaped portion 98, in turn followed by a straight portion 100 co-axial with portion 96. Straight portion 100 is in turn followed by a lateral extension 102 in turn followed by a return portion 104 extending above U-shaped portion 98 and substantially coplanar with the latter. Lateral extension 102 is formed by lateral 90° bends of the return portion 104 and of the straight portion 100 to form two superposed lateral rod sections which are joined at their outer ends by a 180° bend.

Lateral extension 102 extends through elongated opening 88 of the adjacent plate 78 and only into the next guide channel 86. Lateral extension 102 is slidable on the lower edge of elongated opening 88 to thus maintain the selector 26 at the proper level. The selector is maintained in a plane parallel to the guide plates 78 by means of its U-shaped portion 98. The inner end of the return portion 104 is bent through about 180° and is extended by a straight portion 106 terminated at its outer end by an upstanding hook 108.

Figure 7A:
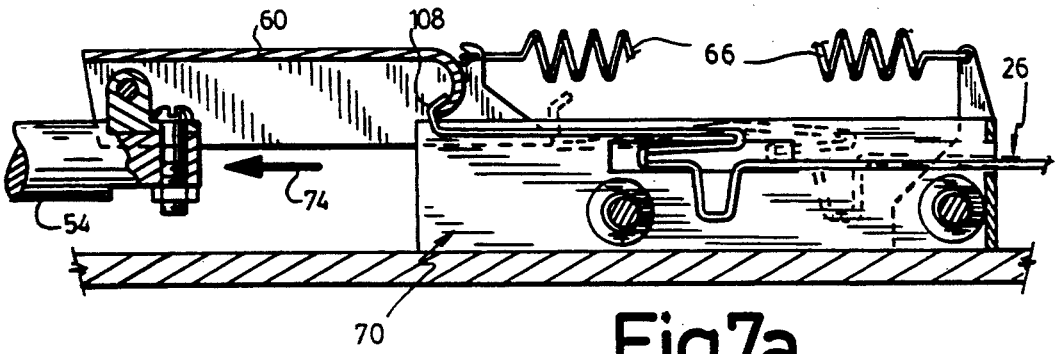
FIGS. 7*a* and 7*b* are views similar to that of FIG. 7 showing successive positions of the device during a sheet turning operation.

In its initial position, the lateral extension 102 of selector 26 is close to the end of elongated opening 88 which is nearer the sheet turning rods 20 as shown in FIG. 7, and its catching hook 108 is in the path of the hook portion 60a of the pulling member 60 and disposed outwardly of the same. A power stroke exerted by the pulling assembly 50 will cause engagement of hook portion 60a with catching hook 108 and pull the first selector 26 from its initial position (see FIG. 7) to its final position which is illustrated in FIG. 7a and in which the lateral extension 102 has reached the opposite end of elongated opening 88 and the lever arm 24 of the first sheet turning rod 20 has pivoted through about one half turn rotating the first sheet from the right hand side of the music stand to the left hand side of the same as shown in FIGS. 13 and 15.

The other selector wires 26a of the set of selectors have the same shape and size as the first selector wire 26 except that the straight portion 106 of the first selector is replaced by a downwardly diverging V-shaped portion 106a and except that its catching hook 108a is slightly higher than catching hook 108.

V-shaped portion 106a defines a section 110 which is downwardly inclined in the direction of catching hook 108a and which rests on the lateral extension 102 of the first selector 26. When second selectors 26a are in their initial position, their lateral extension 102 is close to the inner end of the elongated openings 88 of the respective guide plates 78 and their catching hook 108a are in a down position below the path of hook portion 60a of the pulling member 60 as clearly shown in dotted lined in FIG. 7. It should also be noted that each lateral extension 102 only extends beneath of the next selector of the set as clearly shown in FIGS. 11 and 12.

Figure 7B:
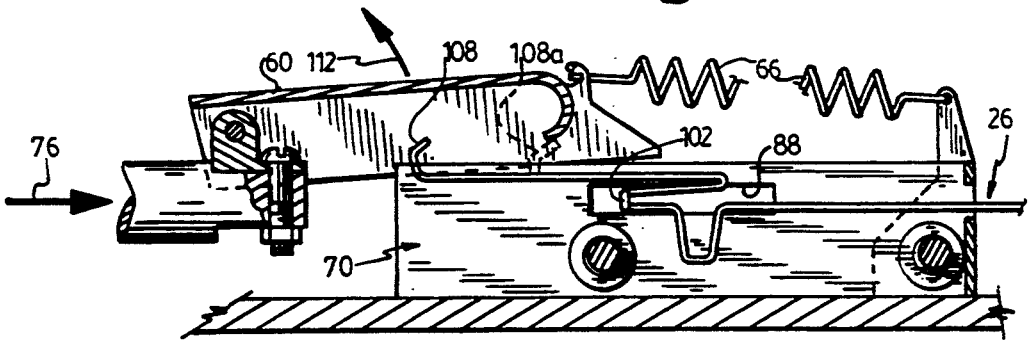

Operation of the sheet turning device is as follows: assuming all of the music sheets 16 or other similar printed sheets or pages are in their initial position stacked on the right hand side of the music stand 2, upon the operator pressing the pedal switch 14, the electromagnet is energized and the plunger 54 moves to the left in accordance with arrow 74 (see FIGS. 7 and 7a). Only the first selector 26 is pulled since the catching hooks 108a of all the remaining selectors are in their downward position as shown in dotted line in FIG. 7 out of the path of the hook portion 60a of pulling member 60. However, during the operative stroke of the first selector 26, its lateral extension 102 rides underneath the inclined section 110 of only the next selector 26a and causes the catching hook 108a of the latter to shift upwardly to an operative position shown in dotted line in FIG. 7b which is in the path of the pulling member 60.

Figure 10:
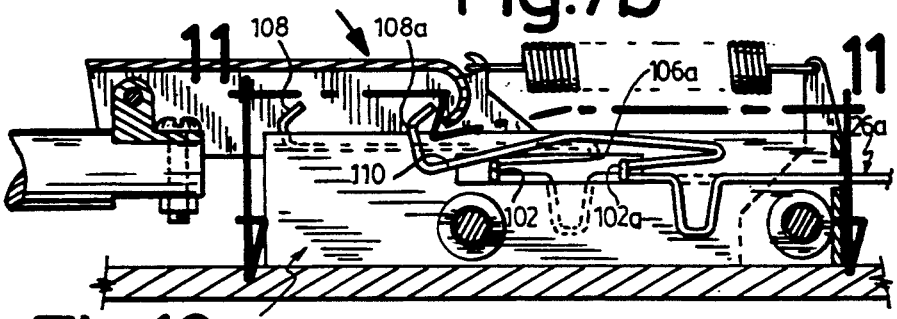
FIG. 10 is view similar to those of FIGS. 7, 7*a* and 7*b* and showing the next position of the device during a sheet turning operation.
Figure 12:
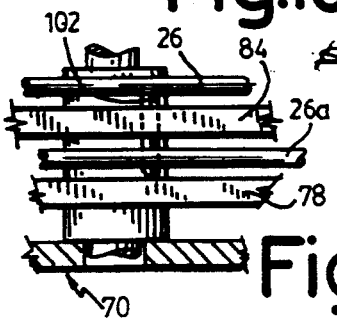
FIG. 12 is a partial enlarged view taken in area of FIG. 11.
Figure 11:
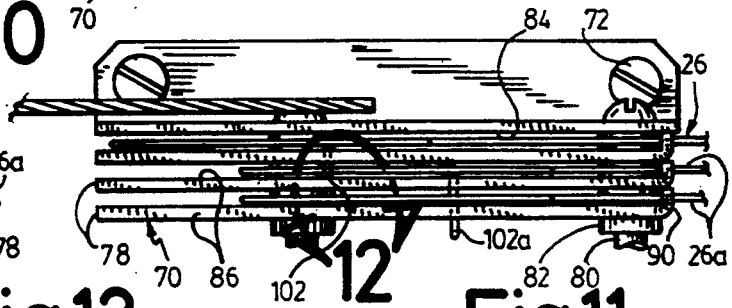
FIG. 11 is a top partial view taken along line 11—11 of FIG. 10.

During the return movement of the pulling member 60 in accordance with arrows 76, its hook portion 60a rides over catching hook 108a as shown by arrow 112, to take the position behind hook 108a of the next selector 26a as shown in FIG. 10.

During the next operative stroke of pulling member 60 only the selector 26a which is next to the first selector 26 is pulled to its final position and during its sheet turning movement its lateral extension 102a shifts upwardly the catching hook 108a of the next selector 26a so that the latter will be pulled during the next pulling movement of member 60.

Therefore, at each pulling movement, only one sheet is turned and the sheets are turned in succession in accordance with the order of the sheet turning rods 20.

While an electromagnet operated plunger 54 has been described, it is understood that the plunger 54 could be operated by a hydraulic power system or an air power system. The electric pedal switch 14 could be accordingly modified to operate a control valve. In the electric system described it is understood that the electromagnet could be operated from a 110V supply instead of a dry-cell battery (B) housed within compartment 8.

I claim:

1. A sheet turning device comprising a support for holding a stack of sheets to be successively turned, a sheet turning rod rotatably secured to each sheet, said sheet turning rods extending side by side, journal means to rotatably support said rods for independent rotation about their longitudinal axis, a lever arm fixed to each rod whereby pulling on a selected lever arm causes rotation of the associated sheet turning rod and turning of the sheet to which said rod is fixed, a set of elongated selector members disposed side by side and each longitudinally movable, guide means to guide said selector members in their longitudinal movement, a common pulling member movable back and forth through an operative stroke and a return stroke in the direction of the longitudinal movement of said selector members and successively engageable with said selector members during its operative stroke to move said selector members from an initial to a final position to turn a sheet, each selector member having a pulling member engaging part and a selector member engaging part, the pulling member engaging part of one said selector member, of the set being in the path of said pulling member when said one selecting member is in its initial position, the pulling member engaging part of all the remaining selector members of the set clearing the path of said pulling member when said remaining selector members are in their initial position, the selector member engaging part of a selector member moving to its final position engaging only the next selector member of the set and transversely shifting said next selector member to a shifted position in which its pulling member engaging part is in the path of said pulling member ready to be pulled by said pulling member from its initial to its final position during the next pulling stroke of said pulling member.

2. A sheet turning device as defined in claim 1, wherein said pulling member engaging part is a first extension upstanding from one end of said selector member and said selector member engaging part is a second extension laterally protruding from said selector member, each selector member of the set except the first one defining just ahead of its first extension a downwardly rearwardly inclined portion engageable by the second extension of the next preceding selector member to shift its first extension upwardly in the path of said pulling member upon movement of said next preceding selector member from its initial to its final position.

3. A sheet turning device as defined in claim 2, wherein said guide means includes a plurality of spaced parallel guiding plates disposed side by side and rigidly interconnected and defining guiding channels each receiving one of said selector members for longitudinal movement therein, said plates having a longitudinal opening through which the second extension of the preceding selector member extends, is guided and is engaged under the next selector member.

4. A sheet turning device as defined in claim 2, wherein each guide plate has a front transverse flange butting against an adjacent guide plate, said flange having a notch through which said selector member extends and is guided against substantial up and down movement.

5. A sheet turning device as defined in claim 3, wherein said common pulling member includes a reciprocating member movable in a predetermined path, a hook lever pivoted for up and down movement on said reciprocating member, a tension spring biasing said hook lever with its hook in the path of the first extension of said selector members and allowing said hook lever to move over the first extension of a selector member which is in the path of movement of said hook lever during said return stroke.

6. A sheet turning device as defined in claim 5, wherein each selector member is a wire bent and shaped to integrally form said first and second extensions.

7. A sheet turning device as defined in claim 6, wherein each wire further includes an integral U-shaped downwardly extending part disposed ahead of said second extension.

8. A sheet turning device as defined in claim 6, wherein the wire of each selector member, except the first one, is bent and shaped to integrally form said downwardly inclined portion.

9. A sheet turning device as defined in claim 8, further including a transparent jacket secured to each rod and having an opening for insertion of a printed sheet to be turned.

10. A page turning device as defined in claim 9, wherein said journal means includes a bar having a series of spaced notches formed longitudinally of said bar and opening at one longitudinal edge thereof, said notches inclined with respect to said bar from their opening in the direction of said selector members whereby a pulling force exerted by said selector members on the rods tends to keep said rods at the closed end of said notch.

11. A page turning device as defined in claim 10, wherein each rod has an enlarged head at its end opposite said lever arm and said journal means further includes an angle iron defining a first flange transverse to said rods and a second flange parallel to said rods, said angle iron defining a series of openings each for receiving the headed end of a rod with the head of the rod on the outside of said first flange, each opening defining an elongated slot in said first flange narrower than said head and a communicating enlarged section in said second flange through which said rod and its head may be removed from said angle iron.

12. A sheet turning device as defined in claim 8, wherein each selector member is a wire bent and shaped to integrally form said first and second extensions and said downwardly inclined portion.

13. A sheet turning device as defined in claim 12, wherein each wire further includes an integral U-shaped downwardly extending part disposed ahead of said second extension.

14. A sheet turning device as defined in claim 5, wherein said first extension is a rounded hook.

15. A sheet turning device as defined in claim 5, further including remotely controlled, power operated means to move said common pulling member through its operative stroke.

* * * * *